US006536688B1

(12) United States Patent
Chun-Lee

(10) Patent No.: US 6,536,688 B1
(45) Date of Patent: Mar. 25, 2003

(54) TWO-PIECE HAND GRIP STRUCTURE OF PISTOL NOZZLE WITH FLOW REGULATING CONTROL KNOB

(75) Inventor: Pong Chun-Lee, Chang Hua (TW)

(73) Assignee: Success & Tech Industrial Co., Ltd., Taichung (TW)

( * ) Notice: Subject to any disclaimer, the term of this patent is extended or adjusted under 35 U.S.C. 154(b) by 0 days.

(21) Appl. No.: 10/153,659

(22) Filed: May 24, 2002

(51) Int. Cl.[7] ..... B05B 1/30

(52) U.S. Cl. ..... 239/581.1; 239/525; 239/526; 239/569; 251/309

(58) Field of Search ..... 239/525, 526, 239/569, 581.1; 251/309

(56) References Cited

U.S. PATENT DOCUMENTS 4,776,517 A * 10/1988 Heren ..... 239/391
5,332,156 A * 7/1994 Wheeler ..... 239/288
6,037,863 A * 3/2000 Collins ..... 340/443
6,367,716 B1 * 4/2002 Wang ..... 239/526

* cited by examiner

*Primary Examiner*—Gregory Huson
*Assistant Examiner*—Amanda R. Flynn
(74) *Attorney, Agent, or Firm*—Bacon & Thomas, PLLC

(57) ABSTRACT

A hand grip structure of the pistol nozzle comprises an upper grip member, a lower grip member, a center tube, a control knob, and a protective cover. The center tube is enclosed by the upper grip member and the lower grip member and is provided with a channel, a water-admitting port and a water-discharging port. The channel is provided in the midsegment with a control cell in which the control knob is disposed such that a push button of the control knob is jutted out of the upper grip member. The control knob is provided with an arresting block. The protective cover is fastened with the lower grip member to soothe the hand. The rate of water flow in the channel is regulated by the control knob.

6 Claims, 7 Drawing Sheets

Fig・1
PRIOR ART

Fig・2
PRIOR ART

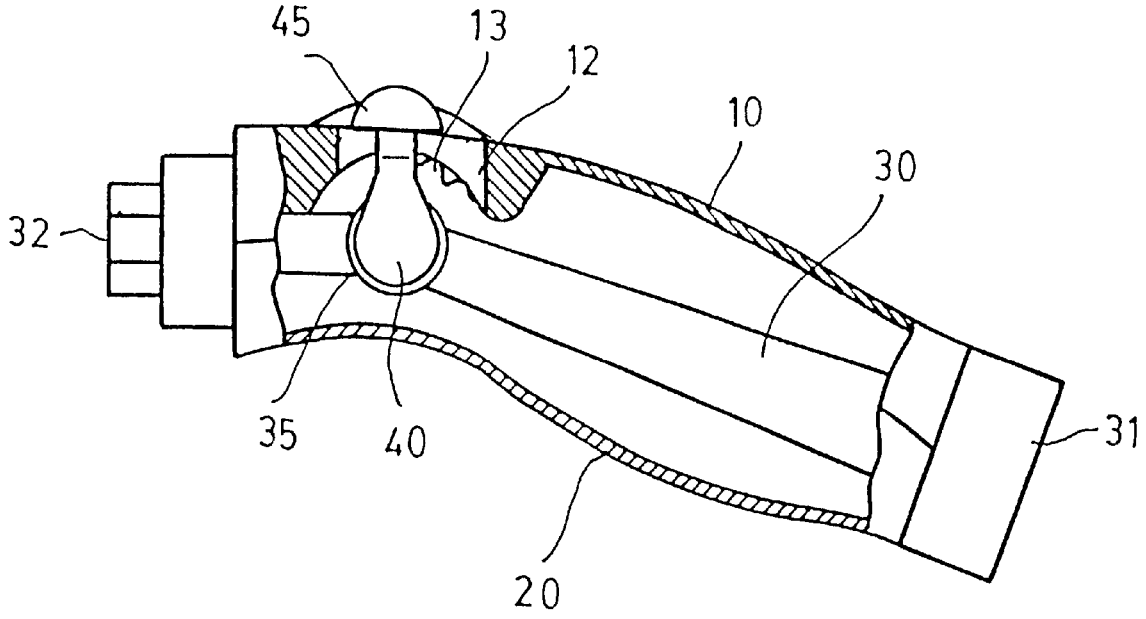
Fig・5

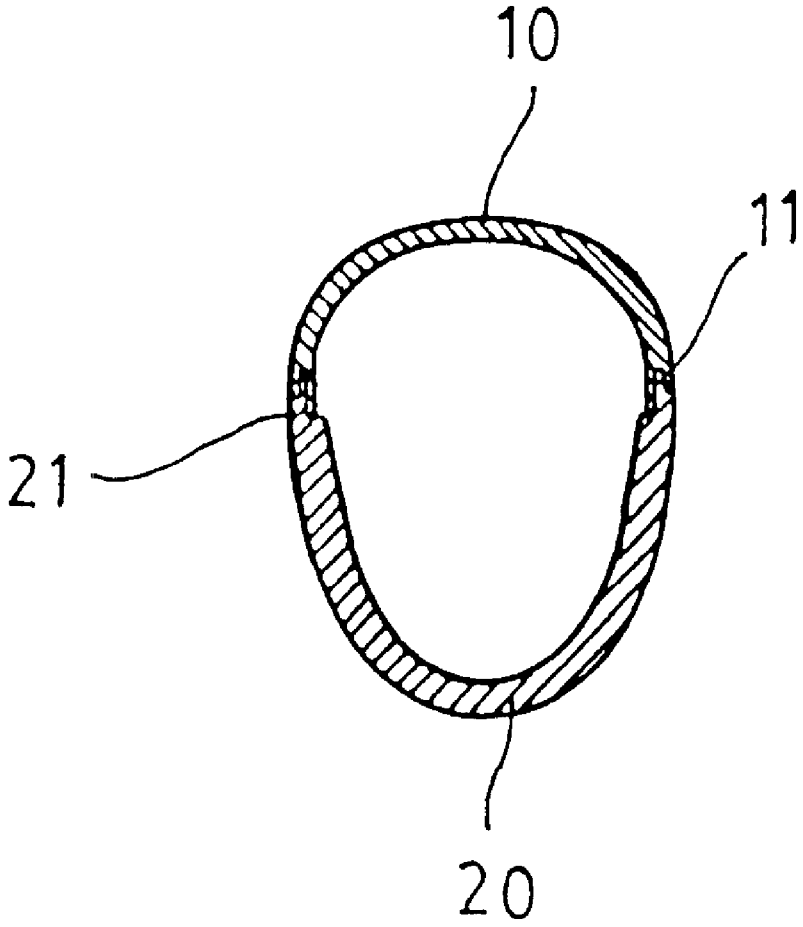
Fig・6

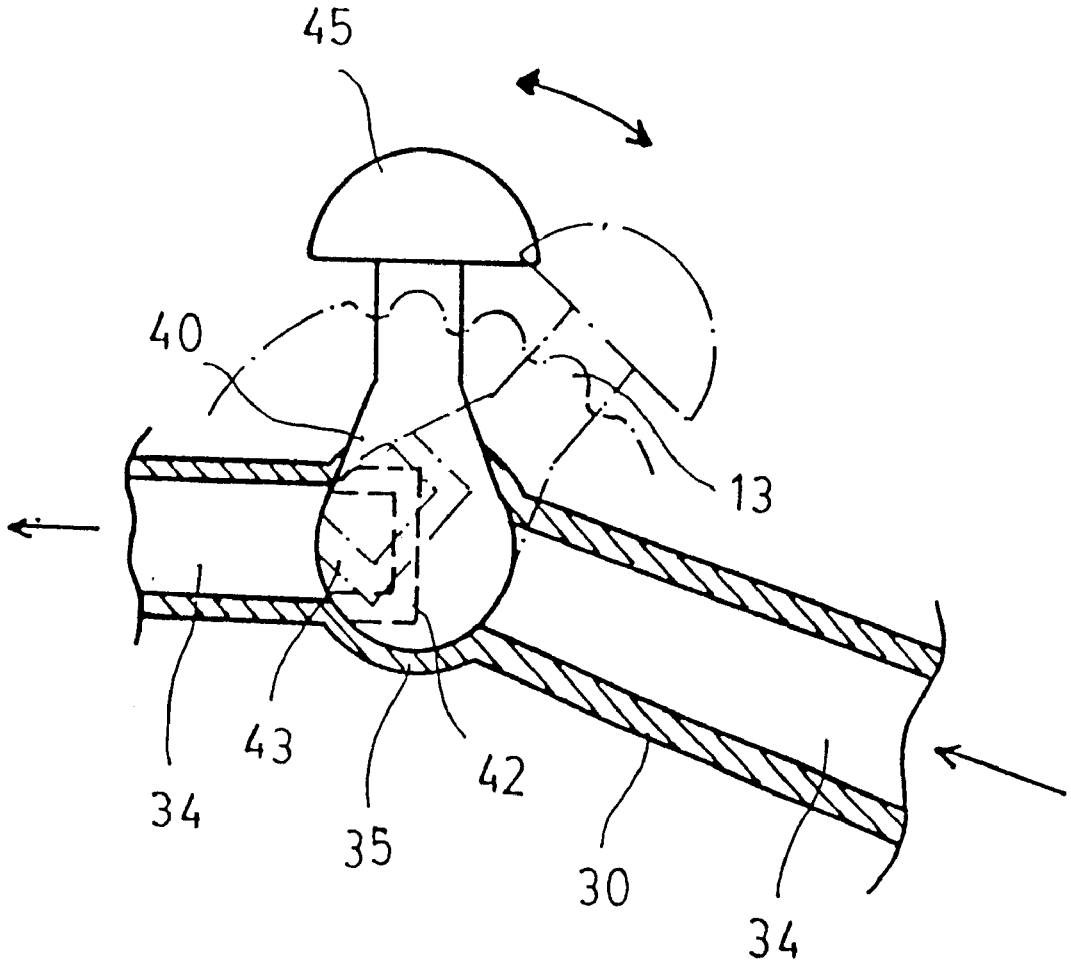
Fig・7

TWO-PIECE HAND GRIP STRUCTURE OF PISTOL NOZZLE WITH FLOW REGULATING CONTROL KNOB

FIELD OF THE INVENTION

The present invention relates generally to a pistol nozzle, and more particularly to a hand grip structure of the pistol nozzle.

BACKGROUND OF THE INVENTION

As shown in FIG. 1, a prior art pistol nozzle comprises a hand grip, a nozzle head fastened with one end of the hand grip, and a control lever fastened with one side of the hand grip to turn on or off a flow of water. The control lever must be pressed with a finger to allow a continuous flow of water. The constant exertion of the control lever for a prolonged of time can cause physical pain in the hand.

As shown in FIG. 2, another prior art pistol nozzle is designed to overcome the deficiency of the prior art pistol nozzle described above with reference to FIG. 1. This improved pistol nozzle comprises a finger press knob in place of the control lever. The finger press knob is incapable of regulating the rate of water flow. In addition, the hand grip is constructed in such a manner that the component parts of the hand grip can not be easily assembled or replaced.

SUMMARY OF THE INVENTION

It is the primary objective of the present invention to provide a pistol nozzle with a hand grip structure which is formed of an upper grip member, a lower grip member, and a center tube. The hand grip structure is so constructed that the component parts of the hand grip structure can be easily assembled or replaced. In addition, the upper grip member and the lower grip member can be variously colored to enhance the esthetic effect of the pistol nozzle.

It is another objective of the present invention to provide a pistol nozzle with a hand grip structure comprising an upper grip member and a lower grip member, which are designed to have a curvature in conformity with the mechanics of human body. In addition, the lower grip member is provided with a protective cover which is made of a material having a softness. The protective cover is intended to soothe the hand which holds the hand grip of the pistol nozzle for a prolonged period of time.

It is still another objective of the present invention to provide a pistol nozzle with a hand grip structure comprising a control knob to turn on or off a flow of water. In addition, the control knob is designed to regulate the rate of water flow in a step-by-step manner.

The features and the advantages of the present invention will be more readily understood upon a thoughtful deliberation reference to the accompanying drawings.

BRIEF DESCRIPTION OF THE DRAWINGS

FIG. 5 shows a longitudinal sectional view of these present invention.

FIG. 6 shows a cross-sectional view of the present invention.

FIG. 7 shows a schematic view of the control knob of the present invention in action.

DETAILED DESCRIPTION OF THE INVENTION

Figure 1:
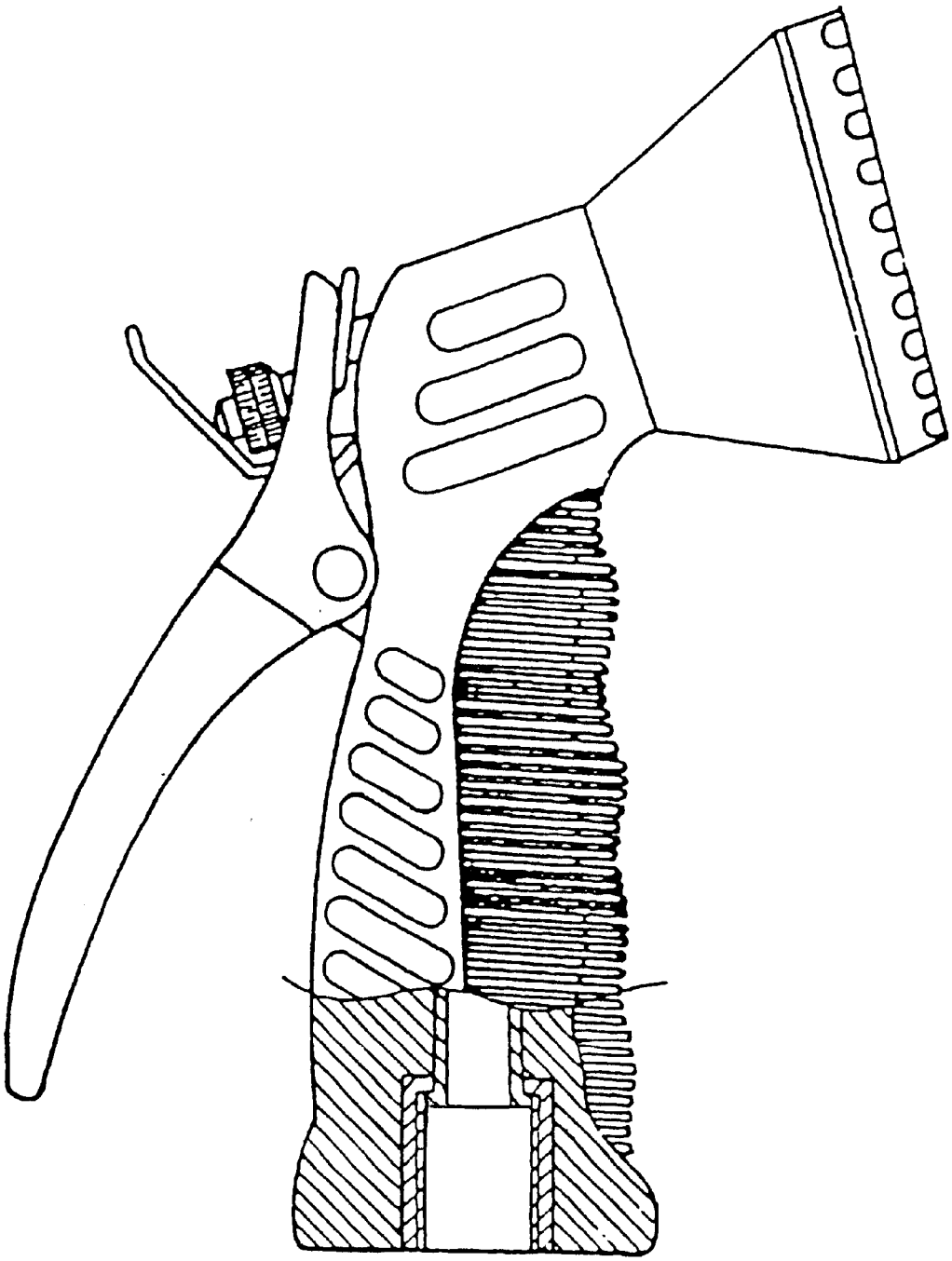
FIG. 1 shows a sectional schematic view of a prior art pistol nozzle.
Figure 2:
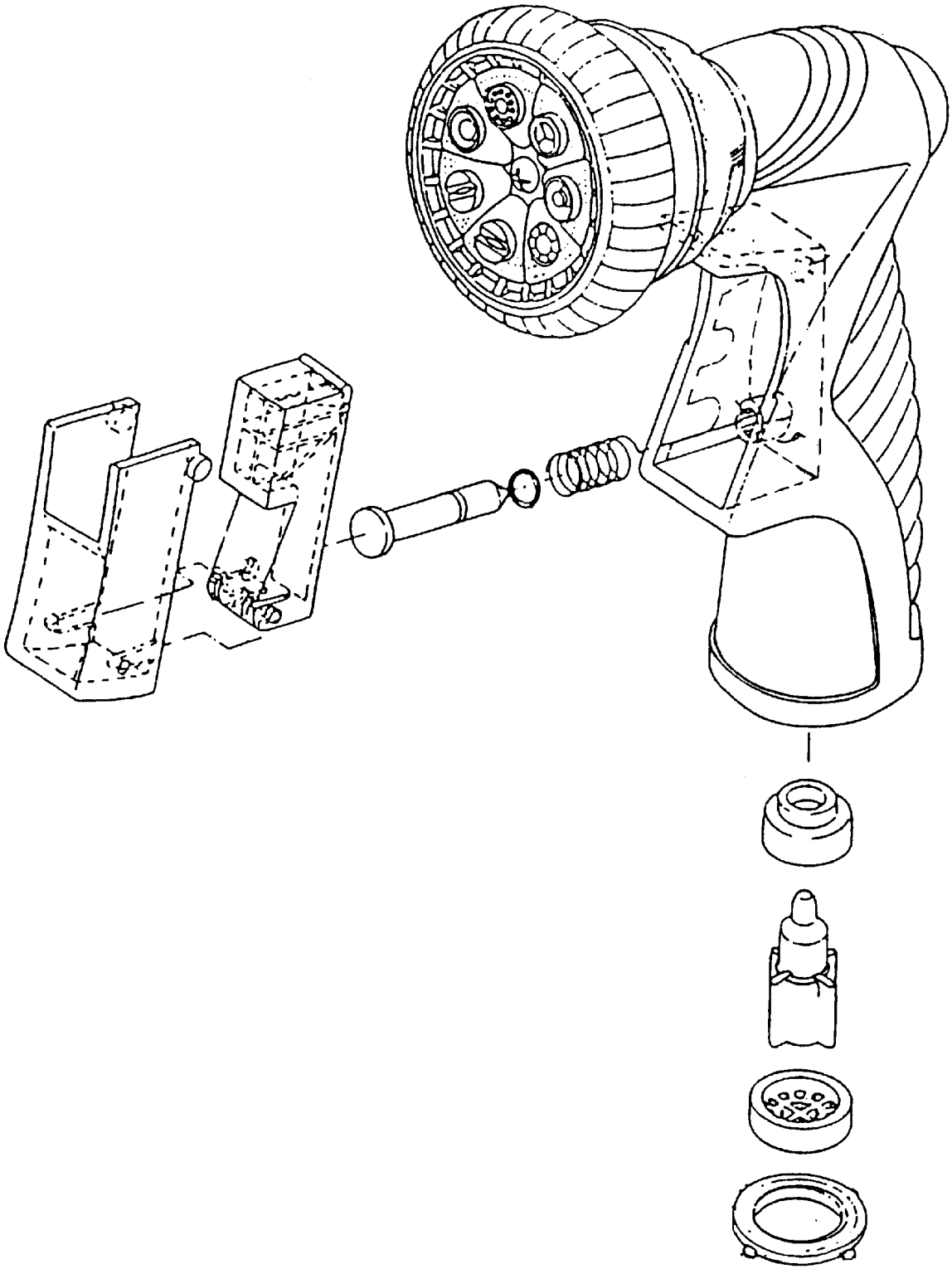
FIG. 2 shows an exploded view of another prior art pistol nozzle.
Figure 3:
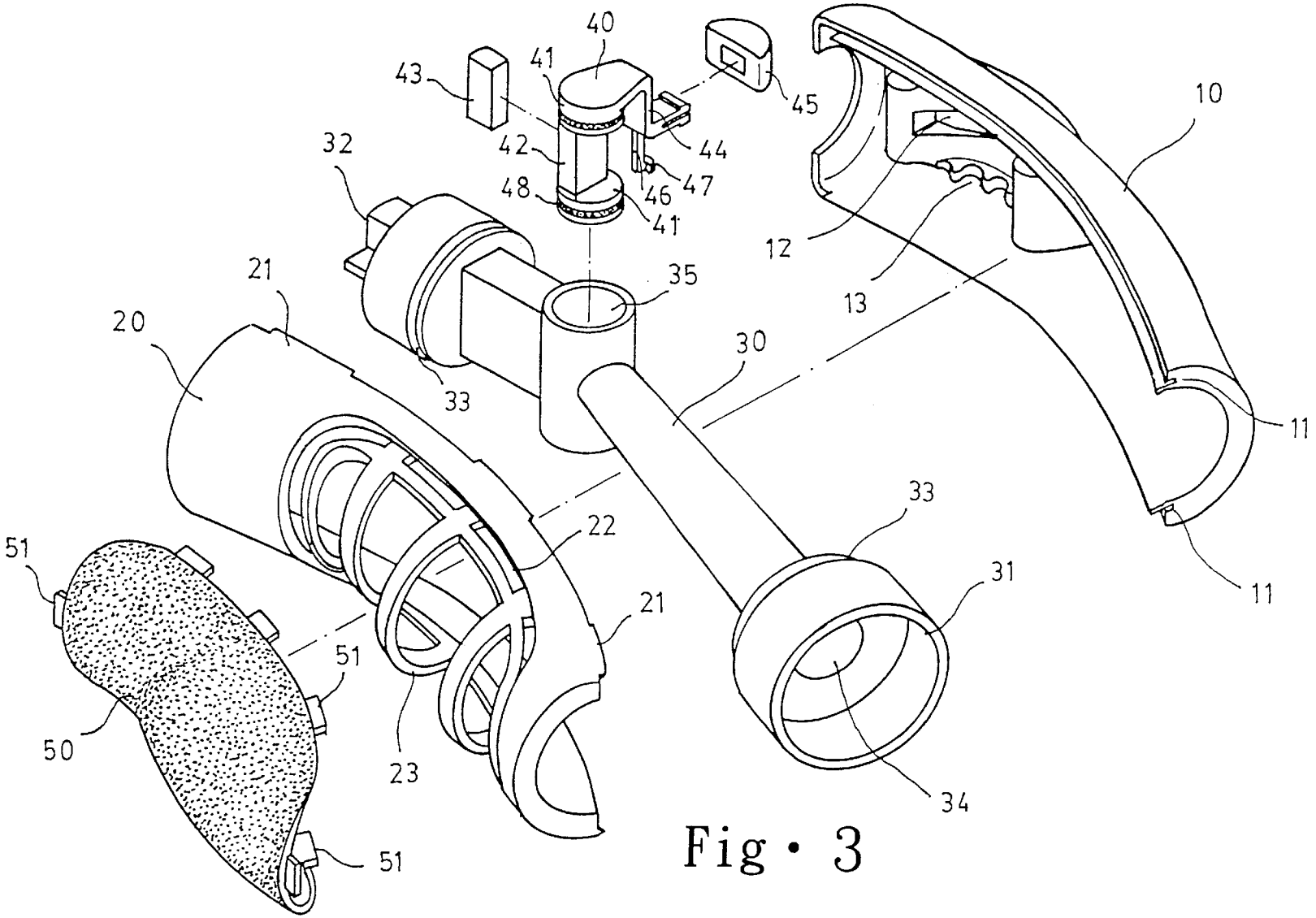
FIG. 3 shows an exploded view of the present invention.
Figure 4:
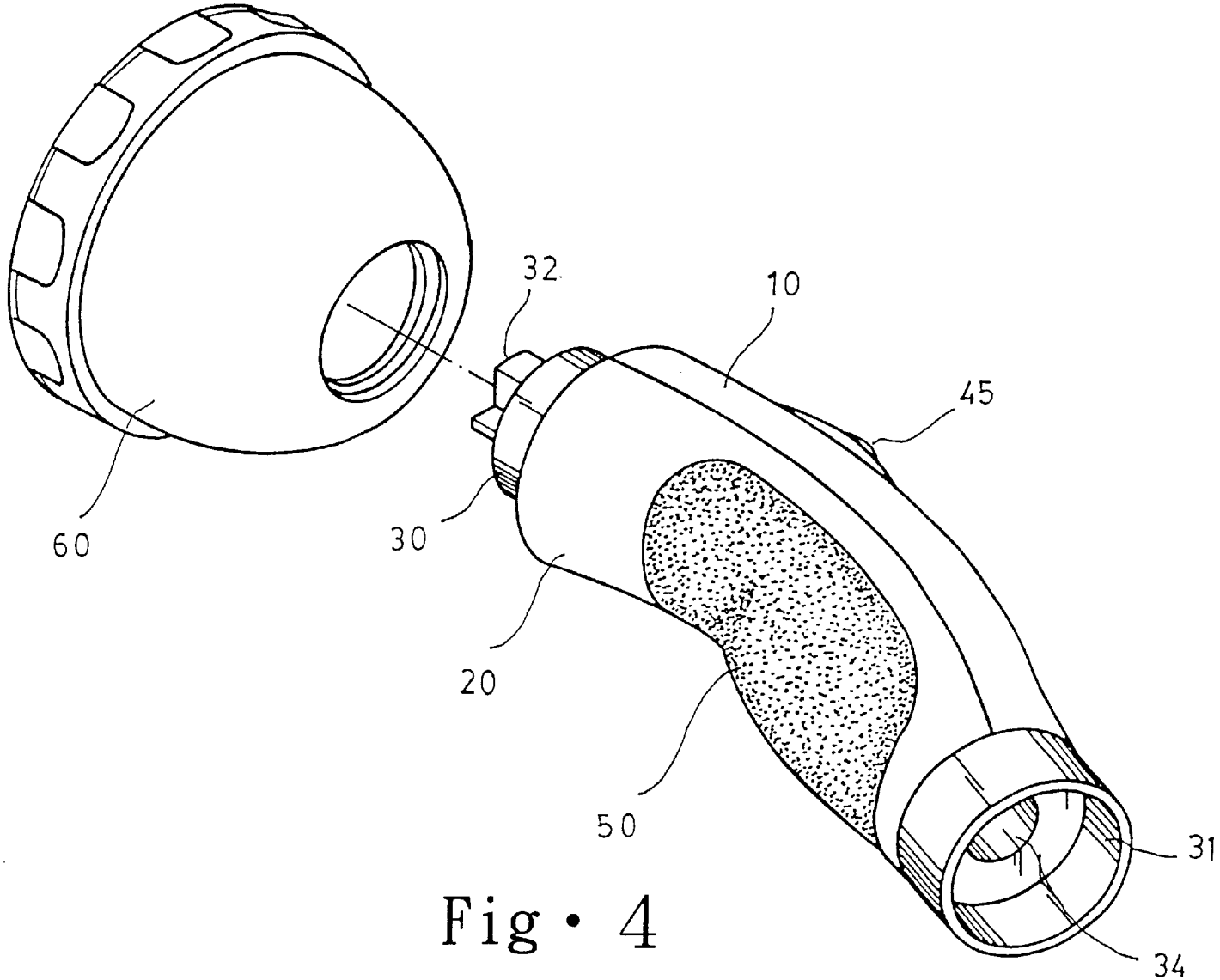
FIG. 4 shows a perspective view of the present invention in combination.

As shown in FIGS. 3–7, a hand grip structure of the present invention comprises an upper grip member 10, a lower grip member 20, a center tube 30, a control knob 40, and a protective cover 50.

The upper grip member 10 is of a hollow and arcuate construction and is provided with two insertion grooves 11. The upper grip member 10 is provided at the front end with an elongated opening 12 which is in turn provided in one side of the bottom thereof with a plurality of locating slots 13.

The lower grip member 20 is of an arcuate hollow construction and is provided with a plurality of insertion pieces 21. The lower grip member 20 is further provided in the bottom with a grip protective cover slot 22 which is in turn provided with a plurality of ribs 23.

The center tube 30 is provided at one end with a water admitting port 31, and at other end with a water discharging port 32, which are provided with a recess 33. Located between the two ports 31 and 32 is a channel 34. The center tube 30 is provided in the midsegment with a control cell 35 in communication with the channel 34.

The control knob 40 is provided with two pivoting blocks 41 opposite to each other, and an arresting block 42 located between the two pivoting blocks 41. The arresting block 42 is provided with a water-stopping block 43. One of the two pivoting blocks 41 is provided with an L-shaped arm 44 extending therefrom and having a push button 45. The arm 44 is provided in the inner side of the bottom thereof with a locating rod 46 which is in turn provided with a locating knob 47.

The protective cover 50 is made of a soft material and is provided in the fringe with a plurality of insertion pieces 51 corresponding in location to the protective cover slots 22 of the lower grip member 20.

In combination, the pivoting blocks 41 of the control knob 40 are fitted with an O-ring 48 before the control knob 40 is put into the control cell 35 of the center tube 30. The control knob 40 is capable of turning in the control cell 35. The water-stopping blocks 43 of the control knob 40 is located at the place between the control cell 35 and the channel 34 facing the water-discharging port 32. Thereafter, the center tube 30 is enclosed by the upper grip member 10 and the lower grip member 20 such that the insertion pieces 21 are inserted into the insertion slots 11, as shown in FIG. 6. Both ends of the upper grip member 10 and the lower grip member 20 are inserted into the recesses 33 of the center tube 30. The push button 45 of the control knob 40 is jutted out of the upper grip member 10 via the opening 12 of the upper grip member 10. The locating knob 47 of the control knob 40 is received in the locating slot of the upper grip member 10. The protective cover 50 is joined with the lower grip member 20 such that the insertion pieces 51 of the protective cover 50 are retained in the protective cover slots 22 of the lower grip member 20, and that the protective cover 50 is supported by the ribs 23 of the lower grip member 20. A nozzle head 60 is fastened with the water-discharging port 32 of the center tube 30.

As shown in FIG. 7, the water-admitting port 31 of the center tube 30 is connected with the water source. As the push button 45 of the control knob 40 is pushed to cause the water-stopping block 43 of the arresting block 42 to locate in the channel 34 in the direction facing the water-discharging port 32, the water flow is stopped by the water-stopping block 43, thereby resulting in interruption in water supply to the nozzle head 60. When the push button 45 is pushed backward to locate in the locating slot 13, the water—stopping block 43 moves away to allow entry of water into the water-discharging port 32, thereby resulting in resumption of water supply to the nozzle head 60. The size of gap formed between the water-stopping block 43 and the channel 34 can be adjusted by the control knob 40, so as to adjust the rate of water flow.

The embodiment of the present invention described above is to be regarded in all respects as being merely illustrative and nonrestrictive. Accordingly, the present invention may be embodied in other specific forms without deviating from the spirit thereof. The present invention is therefore to be limited only by the scopes of the following claims.

What is claimed is:

1. A hand grip structure of a pistol nozzle, said hand grip structure comprising:

an upper grip member of an arcuate hollow construction and provided at a front end with an opening;

a lower grip member of an arcuate hollow construction and corresponding in form to said upper grip member;

a center tube enclosed by said upper grip member and said lower grip member, and provided at one end with a water-admitting port and at the other end with a water-discharging port, with said two ports being located at two ends of a channel, said center tube provided in a midsegment with a control cell in communication with said channel; and a control knob located in said control cell and provided with two pivoting blocks opposite to each other and an arresting block located between said two pivoting blocks, with said arresting block being provided with a water-stopping block for forming an opening between said arresting and said pivoting blocks whereby one of said two pivoting blocks is provided with an L-shaped arm which is provided at a front end with a push button.

2. The hand grip structure as defined in claim 1, wherein said upper grip member is provided with a plurality of insertion slots; wherein said lower grip member is provided with a plurality of insertion pieces whereby said lower grip member is joined with said upper grip member such that said insertion pieces of said lower grip member are retained in said insertion slots of said upper grip member.

3. The hand grip structure as defined in claim 1, wherein said water-admitting port and said water-discharging port of said center tube are provided with a recess for receiving two ends of said upper grip member and said lower grip member.

4. The hand grip structure as defined in claim 1, wherein said lower grip member is provided with a protective cover slot which is ribbed; wherein said lower grip member is provided with a protective cover which is provided with a plurality of insertion pieces and is joined with said lower grip member in such a manner that said protective cover is supported by the ribs of said protective cover slot, and that said insertion pieces of said protective cover are inserted into said protective cover slot of said lower grip member.

5. The hand grip structure as defined in claim 1, wherein said opening of said upper grip member is provided in one side of a bottom thereof with a plurality of locating slots; wherein said L-shaped arm of said control knob is provided in the inner side of a bottom thereof with a locating rod which is provided with a locating knob whereby said locating knob is received in one of said locating slots of said upper grip member.

6. The hand grip structure as defined in claim 1, wherein said two pivoting blocks of said control knob are provided with a waterproof O-ring fitted thereover.

* * * * *